US005875374A

United States Patent [19]

Kikuchi et al.

[11] Patent Number: 5,875,374

[45] Date of Patent: Feb. 23, 1999

[54] IMAGE FORMING APPARATUS WITH DETACHABLE PROCESS CARTRIDGE

[75] Inventors: Yutaka Kikuchi, Kawasaki; Masanobu Kanoto, Tokyo, both of Japan

[73] Assignee: Canon Kabushiki Kaisha, Tokyo, Japan

[21] Appl. No.: 238,048

[22] Filed: May 4, 1994

Related U.S. Application Data

[62] Division of Ser. No. 963,516, Oct. 20, 1992, which is a continuation of Ser. No. 537,786, Jun. 14, 1990, abandoned, which is a division of Ser. No. 175,354, Mar. 30, 1988, abandoned.

[30] Foreign Application Priority Data

Mar. 31, 1987 [JP] Japan ..... 62-078031
Mar. 31, 1987 [JP] Japan ..... 62-078033

[51] Int. Cl.[6] ..... G03G 15/00; G03G 21/00

[52] U.S. Cl. ..... 399/111; 399/116; 399/121

[58] Field of Search ..... 355/200, 210, 355/211, 212, 219; 399/110, 111, 116, 117, 121

[56] References Cited

U.S. PATENT DOCUMENTS

| | | | |
|---|---|---|---|
| 3,827,800 | 8/1974 | Tanaka et al. | 355/271 X |
| 3,912,389 | 10/1975 | Miyamoto | 355/321 |
| 3,966,316 | 6/1976 | Pfeiffer et al. | 399/111 |
| 4,095,879 | 6/1978 | Katayama et al. | 355/326 |
| 4,257,700 | 3/1981 | Tsuda et al. | 355/271 X |
| 4,387,980 | 6/1983 | Ueno et al. | 355/219 |
| 4,455,078 | 6/1984 | Mukai et al. | 355/219 |
| 4,531,823 | 7/1985 | Deguchi et al. | 355/308 |
| 4,575,221 | 3/1986 | Onoda et al. | 355/200 |
| 4,706,320 | 11/1987 | Swift | 355/219 X |
| 4,727,395 | 2/1988 | Oda et al. | 355/270 X |
| 4,754,293 | 6/1988 | Aizawa et al. | 355/309 X |
| 4,760,424 | 7/1988 | Ohba et al. | 355/245 |
| 4,772,915 | 9/1988 | Kando | 346/160 |
| 4,829,335 | 5/1989 | Kanemitsu et al. | 355/211 |
| 4,873,548 | 10/1989 | Kobayashi et al. | 355/211 X |
| 5,164,779 | 11/1992 | Araya et al. | 355/219 |

FOREIGN PATENT DOCUMENTS

| | | |
|---|---|---|
| 255713 | 2/1988 | European Pat. Off. . |
| 322818 | 7/1989 | European Pat. Off. . |
| 331324 | 9/1989 | European Pat. Off. . |
| 59-5251 | 1/1984 | Japan . |
| 59-77450 | 5/1984 | Japan . |
| 60-104958 | 6/1985 | Japan . |
| 60-258030 | 12/1985 | Japan . |
| 63-4252 | of 1988 | Japan . |

*Primary Examiner*—Fred L. Braun
*Attorney, Agent, or Firm*—Fitzpatrick, Cella, Harper & Scinto

[57] ABSTRACT

An image forming apparatus includes a main assembly and a detachable process cartridge mountable to the main assembly. The main assembly has a rotatable image transfer roller for transferring a toner image onto a recording sheet and the process cartridge has a rotatable photosensitive member, a device to form an image on that photosensitive member, a driving force receiving unit provided in the photosensitive member for receiving a driving force from the main assembly so as to rotate the photosensitive member and a driving force outputting unit provided in the photosensitive member for outputting the driving force back to the main assembly to rotate the image transfer roller in the main assembly.

56 Claims, 12 Drawing Sheets

IMAGE FORMING APPARATUS WITH DETACHABLE PROCESS CARTRIDGE

This application is a division of application Ser. No. 07/963,516, filed Oct. 20, 1992, which is a continuation of application Ser. No. 07/537,786, filed Jun. 14, 1990, now abandoned, which is a division of application Ser. No. 07/175,354, filed Mar. 30, 1988, now abandoned.

FIELD OF THE INVENTION AND RELATED ART

The present invention relates to an image forming apparatus, more particularly to a structure of an image forming apparatus, such as a copying machine or a printer, for forming an image on a transfer material.

Conventionally, a copying machine or a laser beam printer or the like which uses an electrophotographic process for image formation, is constructed such that a part of an image forming means or an entire major part of an image forming means (cartridge) as in a personal use copying machine, is taken out of a main assembly of the image forming apparatus to perform maintenance and exchanging operations, more particularly to replenish developer or to exchange a photosensitive drum having a limited service life.

On the other hand, the image forming apparatus is provided with a transfer material passage for conveying the transfer material in the apparatus to the image forming apparatus, and for discharging it outside the apparatus after the image formation, the transfer material conveying passage being openable so as to facilitate manual removal of a jammed sheet.

Referring to FIG. 1A, there is shown an example of a conventional structure wherein an operator opens a front cover, moves a part of the conveying passage Path from an image forming means such as a photosensitive drum; and then, the operator is able to access the opened space to take the jammed paper Pjam.

Referring to FIG. 2A, there is shown another example wherein the conveying passage Path is fixed to a bottom portion AB of the main assembly, wherein an operator moves upwardly an image forming means including a photosensitive drum of the like to open the conveying passage so as to facilitate removal of the jammed paper Pjam. This is called a bivalve type.

Referring to FIG. 2B, another example is shown which is used in a small size apparatus having a low process speed not more than 10 copies per minute, wherein an upper unit AA containing an image forming means is moved upwardly, and then a process cartridge C containing a cleaning means, a changer, a developing device and another changer constituting the image forming means is taken out form the front side of the apparatus for the purpose of maintenance or exchange.

FIG. 1B shows another example, wherein similarly to FIG. 1A, the front cover is opened, and then a cartridge C is removed.

The structure of the first example (FIG. 1A) involves a problem that since the conveying passage is opened within the apparatus, the operator is required to insert his hand through the opening provided in the front plate to take the jammed sheet out of the apparatus, so that it is difficult to remove the jammed sheet. In addition, as shown in FIG. 1B, in this structure, the image forming means is taken out through the front side opening, and therefore, the front plate is required to have a relatively large opening which is disadvantageous from the standpoint of the mechanical strength and production of vibration.

The example shown in FIGS. 2A and 2B involves a problem that the upper unit is more easily influenced by vibration than the lower unit containing the conveying passage and heavy elements such as power source or the like, since the upper unit containing the image forming means such as a photosensitive drum is moved upwardly. Additionally, it is not possible to increase the weight of the upper unit, and the vibration of the image forming means leads to degraded quality of images, such as blurred image. The image forming means is constructed by many precision parts, and therefore, movement of the upper unit can result in an impact influential to those parts.

SUMMARY OF THE INVENTION

Accordingly, it is a principal object of the present invention to provide an image forming apparatus wherein the operativeness is improved during maintenance operations such as jam clearance and cartridge exchange.

According to an embodiment of the present invention, there is provided an image forming apparatus wherein a transfer material conveying means is movable toward and away from an image forming means to facilitate a jam clearance operation.

According to another aspect of the present invention, there is provided an image forming apparatus wherein a part of an entirely of an image forming means is detachably mountable into a main apparatus of the image forming apparatus, and wherein a transfer material conveying means is movable toward and away from the image forming means, and wherein the part or the entirety of the image forming means can be taken out of the apparatus is a direction in which the sheet conveying means is removed.

By making the transfer material conveying means mountable to or dismountable from the image forming means, the jam clearance operation becomes easier, and the number of opening portions is decreased, so that the operativeness is improved.

Also, since conveying passage can be opened largely, and the image forming means remains in the base structure of the main assembly, then the image forming means is not influenced by the shock of opening and closing of the door upon the jam clearance operation.

According to another aspect of the present invention, a sheet supplying inlet and a sheet discharging outlet are located on the same side of the apparatus. By positioning the apparatus so that the side provided with the inlet and outlet is a front side, an operator can have access to the inlet and outlet from the front side, thus facilitating the jam clearance and transfer material supplying operation.

According to another aspect of the present invention, the conveying means is opened at one of the vertical sides, by which another unit such as an image scanner can be disposed on the top of the apparatus, and in addition, the installing area of the entire system can be reduced.

According to another aspect of the present invention, a part or an entirety of the image forming means can be removed from the apparatus in a direction in which a conveying means for conveying a transfer material to the image forming means is opened, and then the necessary part is exchanged. By this, the jam clearance operation and the maintenance operation for the image forming means can be performed in the same direction.

Additionally, the apparatus can provide a large opening upon clearance operation. The large opening can be used for exchange and maintenance of the image forming means, and the space can be used efficiently. Therefore, the operativeness is not degraded even when the size of the apparatus is reduced.

Further, the directions of the supply and discharge of the transfer material, the opening for the jam clearance operation and the opening for the maintenance operation can be made all the same, whereby the area required for the installment can be reduced.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1A:
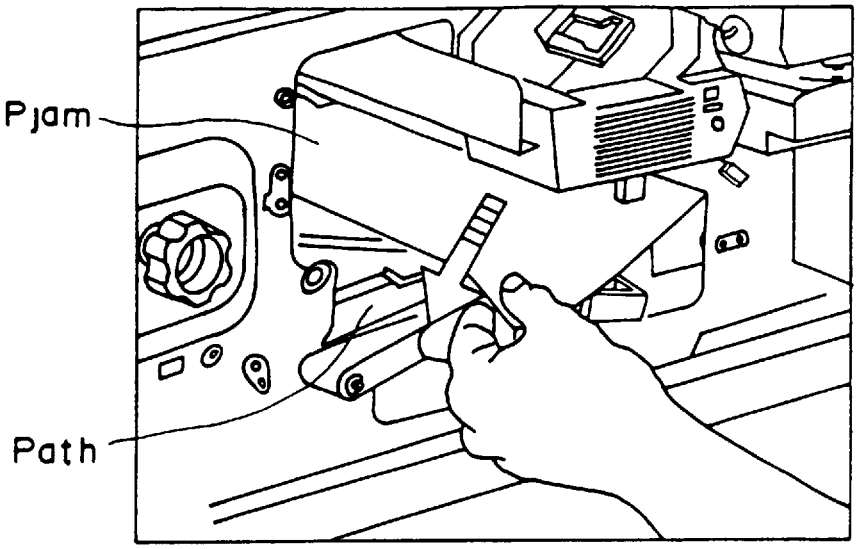
FIGS. 1A and 1B are perspective views illustrating jam clearance operation in conventional machines.
Figure 1B:
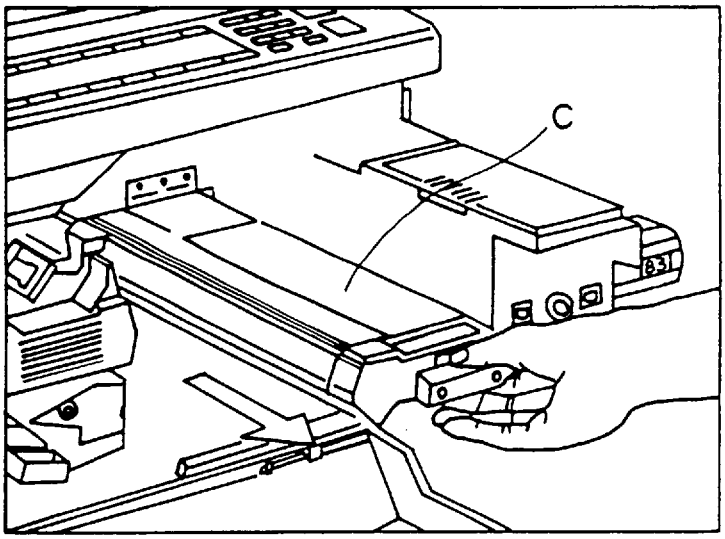
Figure 2A:
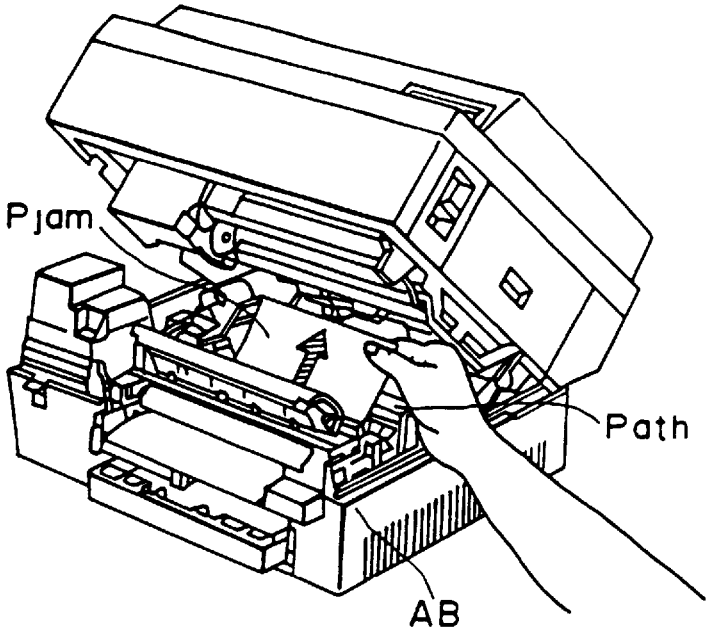
FIGS. 2A and 2B are perspective views illustrating jam clearance operation in other conventional machines.
Figure 2B:
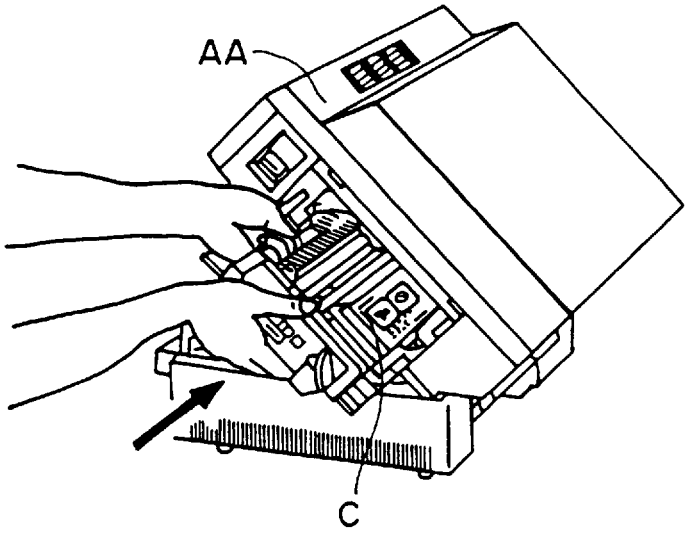
Figure 3:
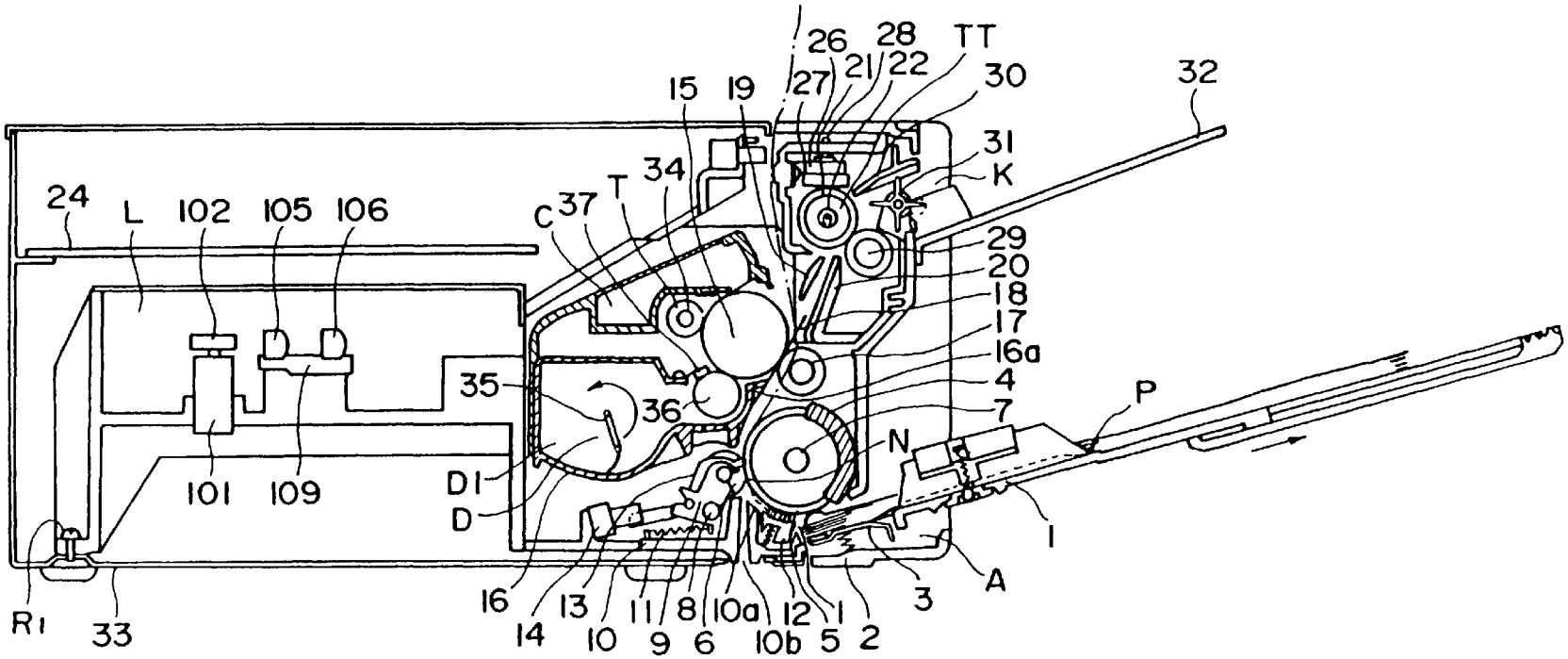
FIG. 3 is a sectional view of a laser beam printer according to an embodiment of the present invention.

Referring to FIG. 3, there is shown a laser beam printer as an exemplary image forming apparatus according to a first embodiment of the present invention.

Figure 4A:
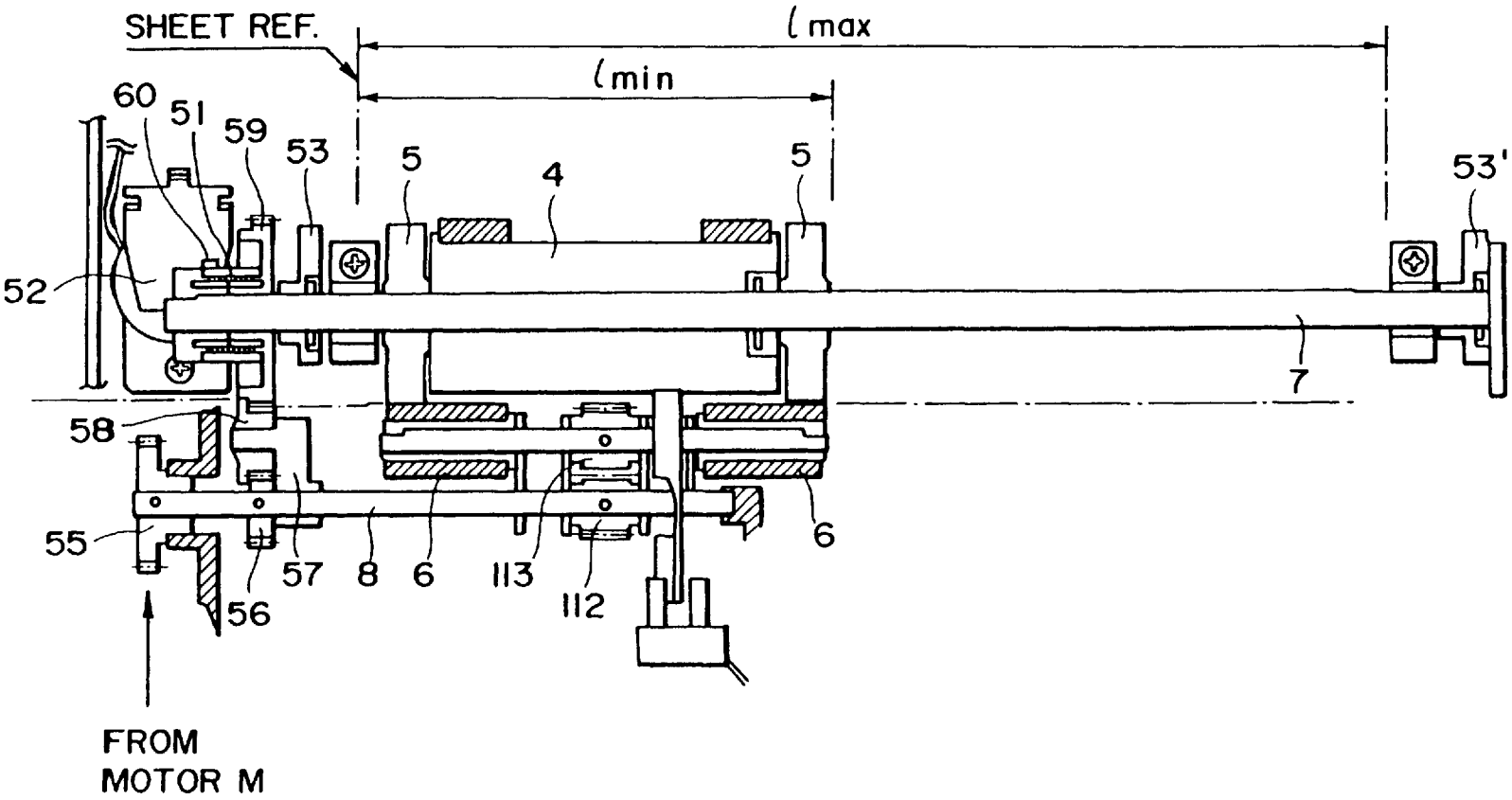
FIGS. 4A, 4B and 4C illustrate detailed structure of sheet conveying means in the laser beam printer of FIG. 3.
Figure 4B:
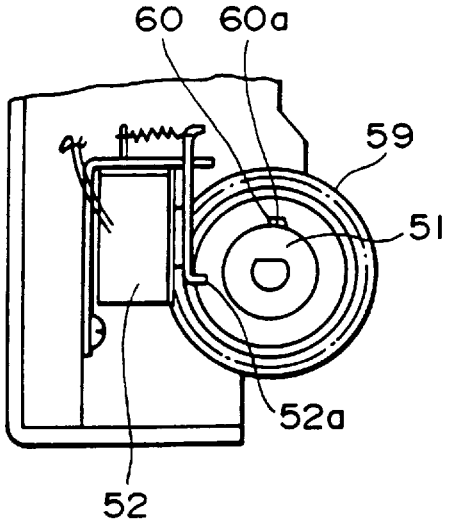
Figure 4C:
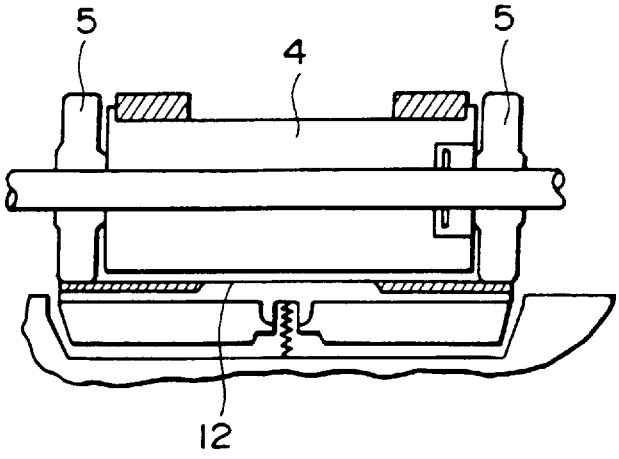
Figure 5A:
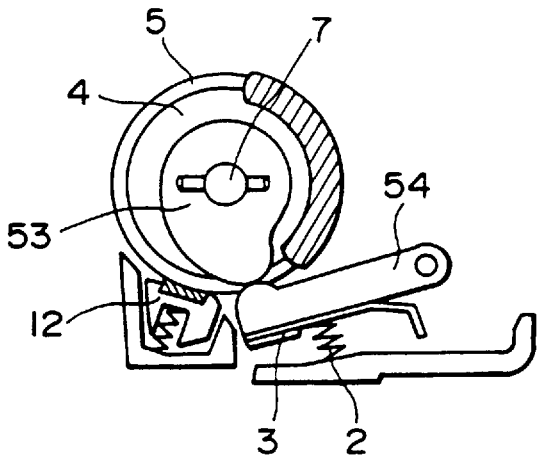
FIGS. 5A and 5B are sectional views of sheet supplying means of the laser beam printer of FIG. 3.
Figure 5B:
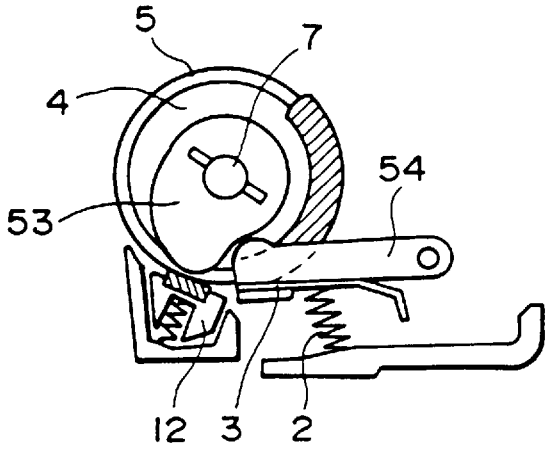

First, the transfer material conveyance to an image forming means will be described referring to FIGS. 3–5.

A number of the transfer materials in the form of cut sheets P are stacked on a sheet feeding tray 1. A stacking plate 3 for stacking the cut sheets P, which is pivotable by the urging force provided by a spring 2, urges the leading edge portion of the stacked sheets P to a feeding roller 4 and an idler roller 5. The feeding roller 4 is provided with a portion having a smaller diameter than the other portion, and the configuration thereof is such that it can take at least one position (initializing position) in which it does not contact the cut sheet P and a conveying roller 6. The idler rollers 5 are disposed adjacent opposite ends of the feeding roller 4 and are smoothly rotatable about a feeding roller shaft 7. The idler rollers 5 have an outer diameter which is slightly smaller than the maximum diameter of the feeding roller 4.

The overall length of the roller arrangement including the feeding roller and the idler rollers 5 is smaller than the minimum width $1_{min}$ of the smallest sheets usable with the apparatus, and the effective portions of the feeding roller (large diameter portion) may be divided into two parts as in this embodiment. The feeding roller 4 is fixed to the driving shaft 7 which is controlled for one turn rotation by a spring clutch 51 and the solenoid 52 adjacent an end thereof.

Figure 6:
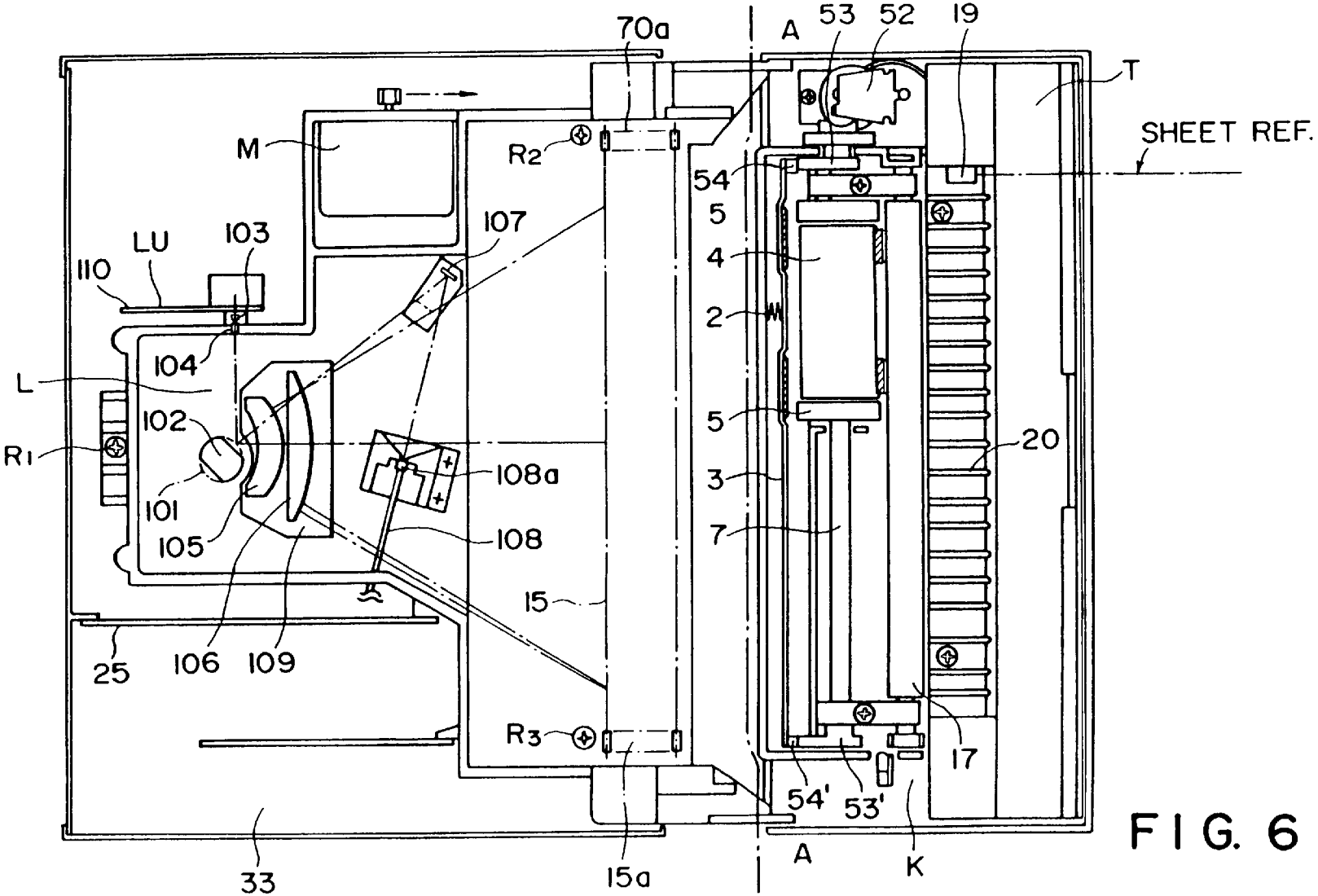
FIG. 6 is a top plan view of the laser beam printer of FIG. 3.

Outside the length of the driving shaft 7 corresponding to the maximum width $1_{max}$ (maximum usable sheet size), cams 53 and 53', for pivotting the stacking plate 3 is mounted to the shaft (FIG. 6). At the positions corresponding to the cams 53 and 53', cam followers 54 and 54' are fixedly mounted on the stacking plate 3, so that the stacking plate 3 is pivoted upwardly and downwardly in response to rotation of the driving shaft 7 to selectively urge the topmost cut sheet P to the feeding roller 4 and the idler rollers 5. When the operator is loading the cut sheets P into the apparatus, the stacking plate 3 takes its lower position as shown in FIGS. 3 and 5A, and therefore, the cut sheets can be smoothly loaded. After the cut sheet is advanced by the feeding roller 4 to such an extent that it can be conveyed by the conveying roller 6 and the idler rollers 5, the stacking plate 3 is lowered to positively prevent the cut sheet or sheets below the topmost cut sheet from being dragged by the topmost sheet which is being conveyed. The conveying roller 6 is pivotable by a swinging arm 9 about a drive input shaft 8 and is normally urged to the feeding roller 4 and the idler rollers 5 by a spring 11 stretched between itself and the apparatus base 10. The driving force to the conveying roller 6 is transmitted by a driving gear 112 fixed to the drive input shaft and a conveying gear 113 fixed to the conveying roller 6. In this embodiment, the driving gear 112 and the conveying gear 113 are disposed adjacent the center of the length of the conveying roller 6, and therefore, the conveying roller 6 is not unbalanced by the application of the driving force to provide a stable contact therebetween.

A separating pad 12 is press-contacted to the feeding roller 4 and the idler rollers 5. The separating pad 12 functions as a friction member pivotably supported at its intermediate position, and is spring-urged at the intermediate position with equalization. The separating pad 12 is of rubber material containing cork. The separating pad 12 is effective to separate the cut sheets. The conveying passage, other than the separating pads, is formed by the guiding portion 10*a* which is integral with the apparatus base 10. The base 10 is provided with a second cut sheet inlet 10*b* for receiving a sheet from other than the feeding tray 1. The sheet fed through this inlet 10*b* is introduced into the nip N formed between the conveying roller 6 and the idler rollers 5. By the provision of this inlet 10*b*, cut sheets can be supplied from another feeding means which is optionally provided below the main assembly of the apparatus, such as a sheet deck or another cassette, and therefore, the function of the apparatus can be expanded. The operation of the sheet conveyance will be described. Prior to the feeding operation, a motor M fixed on the apparatus base 10 and functioning as a driving source, starts to rotate. Then, the driving gear 55(FIG. 4A) fixed on the drive input shaft 8 of the conveying roller 6 starts to rotate, and the driving force is transmitted to the conveying roller 6 from the drive input shaft 8 through the driving gear 112 and 113. Since the conveying roller 6 is press-contacted to the idler rollers 5, the idler roller 5 are rotated together with the conveying roller 6. At this time, even if the idler roller 5 and the cut sheet P are in contact, the cut sheet P is not advanced since the friction force between the cut sheet P and the separating pad 12 is larger than the friction force between the cut sheet P and the idler rollers 5.

In the stand-by period, the stacking plate is urged to its lower position by the cams 53 and 53' and the cam followers 54 and 54', and therefore, the cut sheet P is not contacted to the idler rollers 5. By rotation of a conveying drive gear 55, the driving force is transmitted to the driving gear 56 fixed to the drive input shaft 8, and to a coupler gear 58 meshed with the driving gear 56 and rotatably mounted on a coupler arm 57 swingable about the drive input shaft 8. The coupler gear 58 is provided with a flange, which is contacted to a flange of a sheet feed drive gear 59 constituting the spring clutch 51, so as to compensate backlash. The elements including and upstream of the coupler gear 58 from the motor with respect to the drive transmission, are mounted to the base 10 of the main assembly of the apparatus. The feed drive gear 59 is mounted on a feed roller shaft 7, which is mounted to an outer cover K containing an image fixing station. Therefore, by the mounting and dismounting of the outer cover K, the drive transmission is engaged or disengaged.

The rotation of the feed drive gear 59 is transmitted to a feed roller shaft 7 through a spring clutch 51. The spring clutch 51, when the solenoid 52 is not energized (off), does not transmit the driving force of the feed drive gear 59 to the feeding roller shaft 7, since a pawl 52*a* of the solenoid 52 is engaged with a pawl 60*a* of a control ring 60 of the spring clutch. When, on the contrary, the solenoid 52 is energized (on), the pawl 52*a* of the solenoid 52 is disengaged from the pawl 60*a* of the control ring 60, and therefore, the driving force of the feed drive gear 59 is transmitted to the feed roller shaft. One turn of the feeding roller shaft 1 is controlled in this manner.

When the solenoid 52 is energized in response to a feed start signal, the pawl 60*a* of the control ring 60 is disengaged from the pawl 52*a*, and the driving force of the feed drive gear 59 is transmitted to the driving shaft 7 through the spring clutch 51. when the driving shaft 7 starts to rotate, the cam 53 is rotated to allow the stacking plate 3 to be urged upwardly by the spring 2, by which the cut sheet P on the stacking plate 3 is urged to the feeding roller 4 and the idler rollers 5. At this time, however, although the cut sheet P is contacted to the idler rollers 5, the sheet is not fed out since the friction force between the sheets is larger than the friction force between the sheet and the idler rollers. Simultaneously with, slightly before or slightly after the urging action, that portion of the feeding roller 4 which has the diameter larger than that of the idler rollers 5 comes to contact the cut sheet P, by which the cut sheet P is fed out by the feeding roller 4.

The cut sheet P reaches the separating pad portion where only the topmost sheet P is advanced downstream due to the set relationship between the frictional coefficient sooner or later, the cut sheet P reaches the nip N formed between the idler rollers 5 and the conveying roller 5 being driven, whereafter the cut sheet is conveyed by the conveying roller 6 at a stabilized speed.

Downstream of the nip N formed between the conveying roller 6 and the idler rollers 5, there is disposed a sensor lever 13 which is rotatably supported on the swingable arm 9 and which serves to detect a leading edge of the cut sheet P with the aid of a photointerruptor 14. The sheet sensing mechanism in this embodiment is constituted by the sensor lever 13 and the photointerruptor 14, as shown in the Figure, but this is not limiting, and a sensor of a transparent type or a reflection type may be used. After the leading edge of the sheet is detected, the cut sheet P is conveyed to a neighborhood of the photosensitive drum 15 of the image forming means by the conveying roller 6 and the idler rollers 5. During this conveyance in this embodiment, the sheet P is guided to the photosensitive drum 15 by guides 16a in the form of ribs into which a part of a casing 16 for the developing device D is formed, so that the sheet P can be conveyed accurately with low cost and easy manufacturing. A toner image formed on the photosensitive drum 15 through an image forming process which will be described hereinafter is transferred onto a transfer material by a transfer roller 17 which is pressed to the photosensitive drum 15 under a total pressure of 300–1000 g and which is driven by a driving force outputting (or transmitting) gear 15*a* disposed adjacent a longitudinal end of the photosensitive drum 15 or which rotates following the photosensitive drum 15. The transfer roller 17 is made of a semiconductive rubber having a volume resistivity of $10^2$–$10^5$ ohm.cm. During the transferring operation, the transfer roller 17 is supplied with a bias of DC 500 V–1500 V having a polarity opposite to that of the toner. The toner image is transferred onto the cut sheet P (transfer material) from the photosensitive drum 15 by transporting the cut sheet P between the photosensitive drum 15 and the transfer roller 17. After the image transfer, the cut sheet P is conveyed by the transfer roller 17. It is noted that the tendency of the cut sheet P being attached to the photosensitive drum 15 after the image transfer, increases with the bias voltage applied to the transfer roller 17 and with decrease of the thickness and weight of the transfer material.

In order to assure the separation of the cut sheet P from the photosensitive drum 15, assisting means for assisting the separation is employed, which is in the form of a sheet material 18 made of MYLAR (aluminized polyester) or the like and which is extended from the inlet guide 16*a* to a downstream position of the nip N between the transfer roller 17 and the photosensitive drum 15. The sheet material 18 is close to or contacted to the photosensitive drum 15 at a position adjacent the sheet reference side and at such a position that it is contacted to the sheet by several mm from a reference position and in a non-image forming portion. That part of the transfer roller 17 which correspond to the sheet material 18 is reduced in diameter by the amount not less than the thickness of the sheet material so that the conveying force by the transfer roller 17 is not applied to the sheet material 18.

Thus, the image carrying side of the cut sheet P is guided by the sheet material 18 in the non-image forming area adjacent the lateral sheet reference end. At a position slightly away from the photosensitive drum 15 in this embodiment, a non-image forming portion guiding member 19 is disposed in the conveyance passage after the image transfer station to guide the lateral edge of the cut sheet in place of the sheet material 18 which has been separated from the photosensitive drum 15 by the sheet material 18. By the provision of the guide 19, the length of the sheet material 18 which is made of a material such as MYLAR which is easily bent, deformed or influenced by heat, can be minimized, by which the deformation or the like can be prevented. The side, the opposite from the image carrying side, of the transfer sheet is guided by a conveyance guide 20 which also functions as an inlet guide to the fixing station, so that the cut sheet is guided to the fixing station T.

The fixing station T includes a fixing roller 21 which is made of aluminum pipe coated with TEFLON (tetrafluoroethylene resin) and which is rotationally driven, includes and a halogen heater 22 as a heating source in the fixing roller 21. The temperature of the fixing roller 21 is detected by a thermister 23 disposed in contact with the fixing roller adjacent a position within the non-image forming area and sheet passing portion. The temperature thereof is controlled by a DC controller 24 and an AC controller 25 in the main assembly of the apparatus. As a safety measure, a thermo-switch 26 is disposed above the fixing roller 21 adjacent a center of the maximum length $1_{max}$ of the fixing roller 21 in non-contact with the fixing roller 21 to prevent overheating of the fixing roller 21. The distance between the thermo-switch 26 and the fixing roller 21 surface is adjustable, since the thermo switch 26 is normally urged by a leaf spring 27 in a direction away from the fixing roller 21, while an adjusting means such as a screw 28 is mounted at the backside thereof.

The pressing roller 29 is provided to press the cut sheet to the fixing roller under a total pressure of 3–6 kg. The pressing roller 29 is coated with a silicone rubber. The pressing roller 29 is driven by the fixing roller 21. The toner image on the cut sheet P is fixed by passing the cut sheet P through the nip formed between the fixing roller 21 heated and the pressing roller 29.

After the image fixing, the cut sheet P is guided by outlet upper guide 30 which also functions as a separating guide. The guide 30 is close to but not contacted with the fixing roller 21 by a space not more than 1 mm to prevent the cut sheet P from wrapping around the fixing roller 21. The cut sheet P is guided to a discharge paddle 31 disposed downstream of the couple of the fixing roller 21 and the pressing roller 29. The discharge paddle 31 is made of an elastic material such as rubber or elastomer having several projections in the form of blades. The free ends of the discharge paddle 31 enter a space defined by ribs of the upper guide 30 to overlap with the ribs to urge the cut sheet P to the discharge paddle 31 by the resiliency of the sheet and the flexibility of the discharge paddle 31. The rotation of the discharge paddle 31 conveys the cut sheet P with the aid of the friction force of the blade projection. The cut sheet P is then discharged outside the apparatus and is stacked on a discharge tray 32 at the sheet discharge outlet. The discharge tray 32 is easily dismountable.

The above-described feeding station, conveying station, image fixing station and sheet discharging station are supported as a unit openable by a swinging action about a shaft A on the apparatus base 10, more particularly, the apparatus is separable on a line indicated by a chain line in FIG. 3.

Figure 7:
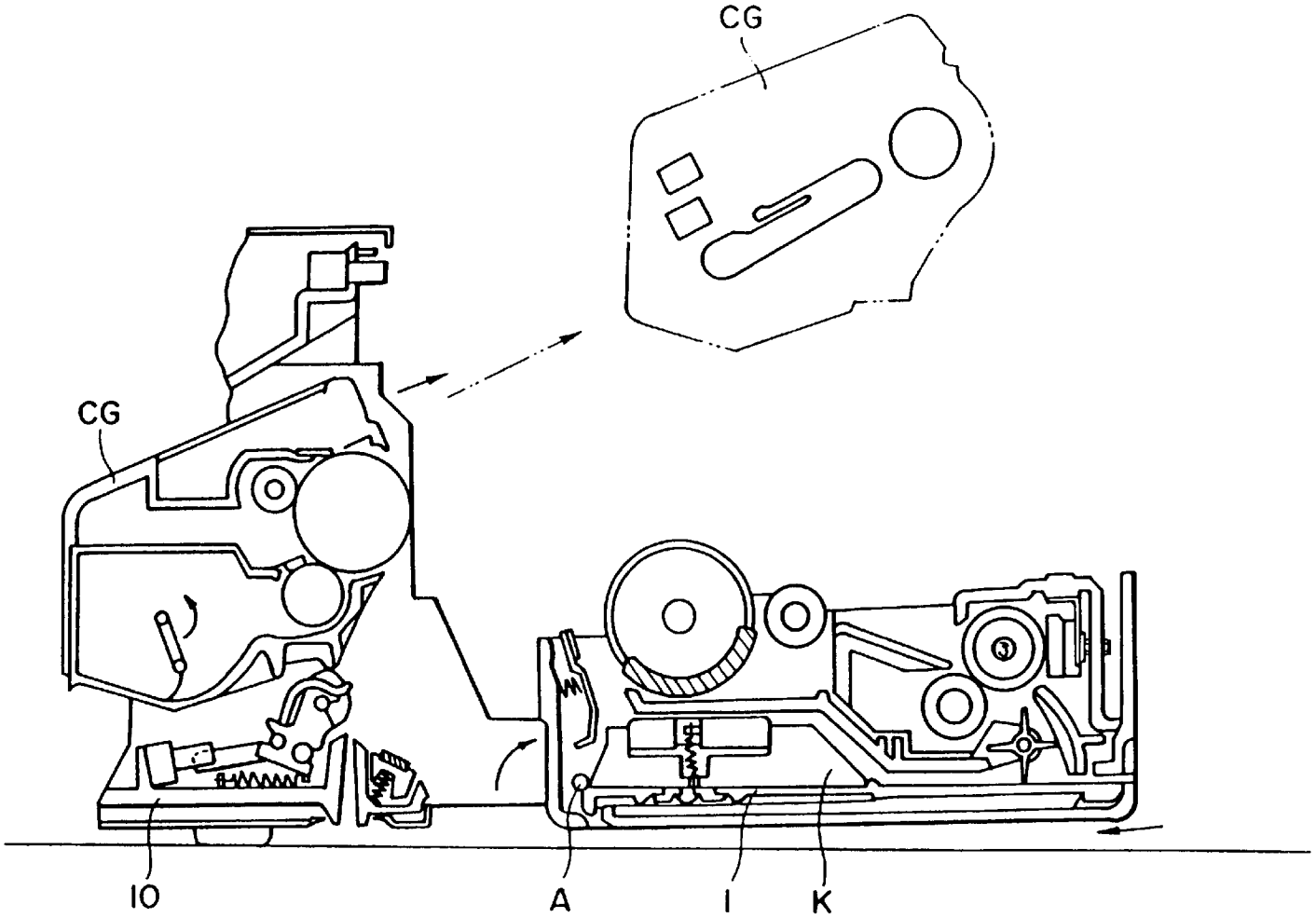
FIG. 7 is a sectional view of a part of the laser beam printer of FIG. 3.

FIG. 7 shows the apparatus when it is opened. In the shown state, the sheet discharge tray 32 is removed, and the feeding tray 1 is folded with the cut sheets removed.

The description will be made as to the image forming station including an optical system. As described hereinbefore, the base 10 is provided with means for supporting an outer cover K containing the sheet feeding and image fixing means rotatably about the shaft A and for guiding and positioning a cartridge containing the photosensitive drum 15 or the like which constitutes an electrophotographic image forming station. A laser beam optical system L for projecting light image onto the photosensitive drum 15 is supported on the base 10.

The laser beam optical system L includes a rotatable mirror, more particularly a polygonal mirror 102 in this embodiment, mounted to an output shaft of a motor 101 which rotates at a high speed. The polygonal mirror receives a laser beam from a semiconductor laser 103 through a collimator lens 104 and reflects it by the polygonal surfaces 102. The reflected beam is incident on the surface of the photosensitive drum 15 through a spherical lens 105 and an F-θ lens 106. By the rotation of the polygonal mirror 102, the photosensitive drum 15 is scanned with the laser beam in the direction of the generating line, during which the semiconductor laser 103 is on-off-controlled to form dot images on the generating line of the photosensitive drum 15. In order to provide a reference in the scan in the direction of the generating line of the photosensitive drum 15 by the polygonal mirror 102, a beam detector mirror 102 is disposed outside an image formation range within the scanning range at a scan starting side. The laser beam reflected by the beam detector mirror 107 is received by a laser receiving surface 108a of an optical fiber 108, which surface is disposed at a position which is optically away from the polygonal mirror by a distance equivalent to an optical distance between the photosensitive drum 15 and the polygonal mirror. By the optical fiber 108, the received laser beam is transmitted to a laser receiving element of the DC controller 24.

The beam detection by the beam detector provides a reference timing for the laser scan to determine the image signal producing timing. More particularly, upon a predetermined number of clockpulses from the reference timing, the image signals start to be transmitted to the semiconductor laser 103, by which the main scans are correctly aligned.

As described, the laser beam optical system L contains many precision elements such as lenses, a high speed motor or mirrors, and if the positions relative to the photosensitive drum 15 is deviated, the deviation of the image, non-perpendicularity or other problems in the image result. In this embodiment, the process cartridge containing the photosensitive drum 15, the polygonal mirror motor 101 mounted to the the polygonal mirror of the laser beam optical system L, a lens mount 109 for positioning the spherical lens 105 and the F-θ lens 106, the beam detection mirror 107, the light receiving portion 108*a* for detecting the beam and the semiconductor laser unit LU including a semiconductor laser, a base plate 110 for the semiconductor laser and the collimator lens 104, are mounted fixedly on the apparatus base plate 10, by which the positional accuracy can be maintained. By this, the positional accuracy can be improved. The base 10 is fixed to the bottom plate 33 at three points R1, R2 and R3. By this, the apparatus is less influenced by deformation and twisting of the bottom surface.

The description will be made as to the image forming station (electrophotographic process station). The image forming means in this embodiment includes a cartridge containing as a unit the photosensitive drum 15, a cleaning station C, a primary charging station T and a developing station D.

The primary charging station T in this embodiment includes a rubber roller 34 which is supplied with DC and AC bias to electrically charge the photosensitive drum 15 which is of an organic photoconductor. The rubber roller 34 rotates following the photosensitive drum 15 and is contacted to the photosensitive drum 15 under several hundred grams. After being subjected to the operation of the primary charging station, the photosensitive drum is exposed to image light provided by the above-described laser beam optical system L, by which the potential of the exposed portion is −50–−150 V. Next, in the developing station D, the toner is supplied to a developing sleeve 36 by a stirring means 35 from a toner container D1 containing toner particles electrically charged to the same polarity as the polarity of the primary charge. Then, the rubber blade 37 contacted to the surface of the developing sleeve 36 forms a layer of the toner particles on the surface of the developing sleeve 36. The photosensitive drum 15 and the sleeve surface is spaced apart by 200–300 microns with an AC vias applied across the clearance. By this, the portion of the photosensitive drum 15 which has been exposed to the laser beam receives the toner particles (jumping development), so that a reversal development is performed. The toner image thus formed on the photosensitive drum 15 is transferred to the transfer material (cut sheet) as described in the foregoing. The toner remaining on the photosensitive drum 15 after the image transfer is removed from the photosensitive drum 15 at the cleaning station C. The removed toner particles are collected in the residual toner container C1 by the movement of the toner particles indicated by an arrow.

The photosensitive drum 15 which has now been cleaned by the cleaning station C is reusable for the next image forming process. After a predetermined number of image forming operations, the cartridge is exchanged with a new one. The predetermined amount is determined in consideration of the service life of the photosensitive drum 15, the service life of the cleaning blade and consumption of the toner. For this exchanging operation, the cartridge is removed through a side of the apparatus where the outer cover K having the sheet feeding, the sheet conveying and image fixing stations, is provided. Since the cartridge is removed in that direction, the cartridge can be taken out of the apparatus in the direction perpendicular to the generating line of the photosensitive drum. Additionally, after the new cartridge is mounted into the apparatus, the outer cover K is closed, by which the cartridge is placed at a correct position by being pressed by the transfer rollers or the like with certainty.

Figure 8:
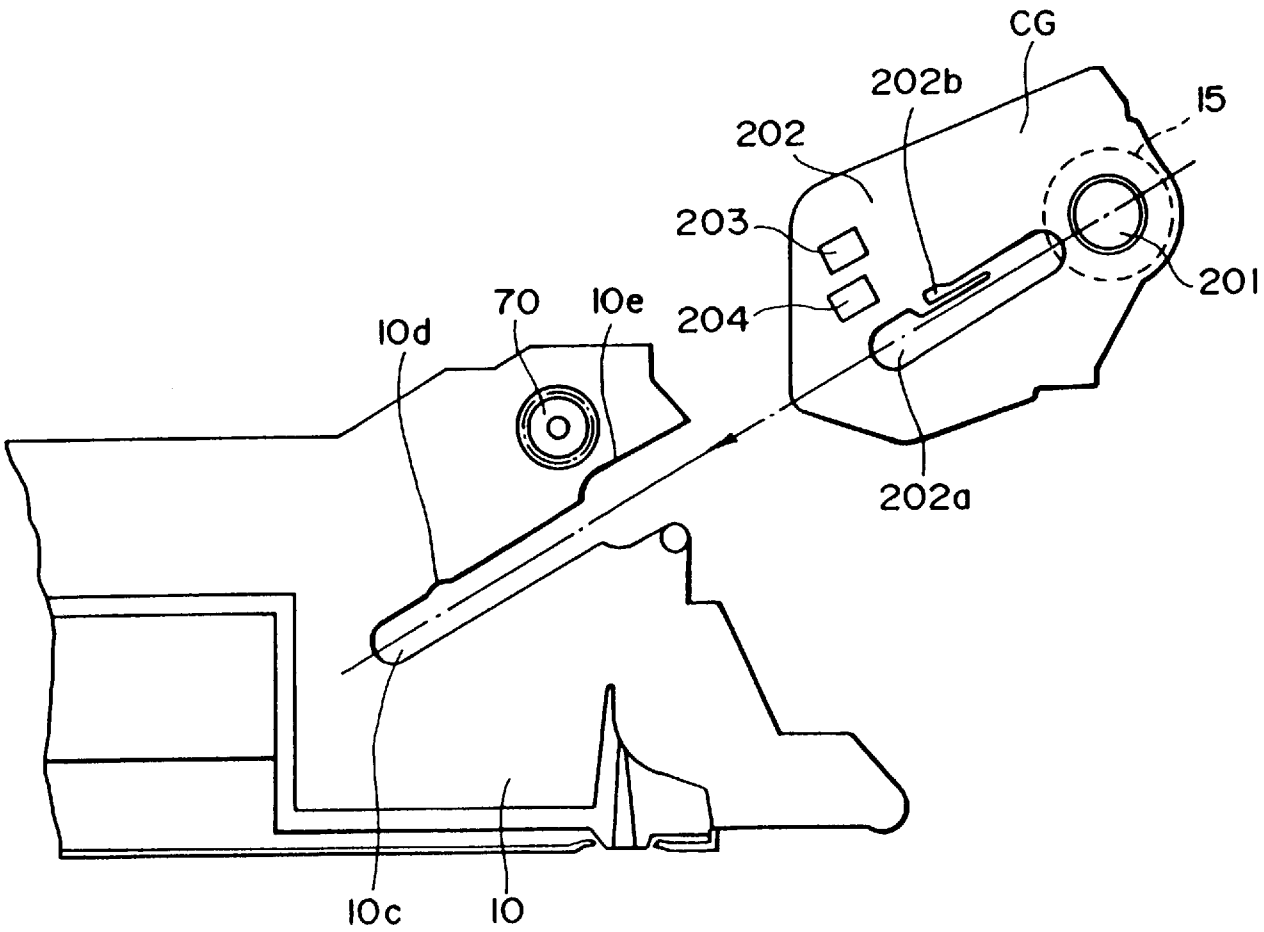
FIG. 8 illustrates mounting and dismounting of a part for the maintenance operation.

FIG. 8 illustrates the positioning of the cartridge CG to the apparatus base. The cartridge CG is provided on its sides with drum pins 201 rotatably supporting the photosensitive drum 15 shown by broken lines, guiding portions 202*a* formed on an outer frame 202 and click spring portions 202*b*. On the other hand, the apparatus base 10 is provided at both sides with guiding recesses 10*c* for guiding the guiding portions 202*a*, click recesses 10*d* for receiving the click springs 202*b* and positioning portions 10*e* for positioning the photosensitive drum 15. The photosensitive drum 15 is driven, via a driving force receiving gear 70*a* (See FIG. 6), by a drum driving gear 70 (See FIG. 8) rotatably supported on a side of the apparatus base 10.

The process cartridge is provided at a side opposite from the side associated with the drum driving gear, with electric contacts 203 and 204 for high voltage or the like to accomplish electric connection with unshown electric contacts of the base 10. The photosensitive drum 15 in the cartridge CG is correctly positioned with respect to the apparatus base 10 by the drum pin 201, and the process cartridge is positioned by the guiding portion 202*a* in the rotational direction. As described in the foregoing, according to this embodiment, a part or the entirety of the image forming means can be removed from the same side of the apparatus when the maintenance operation is performed for the image forming means and when a jammed sheet is removed, and therefore, a wide area of space is not required for installment of the apparatus, and the size of the apparatus can be reduced.

Additionally, the operator accesses the apparatus to the same side in the maintenance operation and the am clearance operation, so that the manipulation is easier.

Figure 9A:
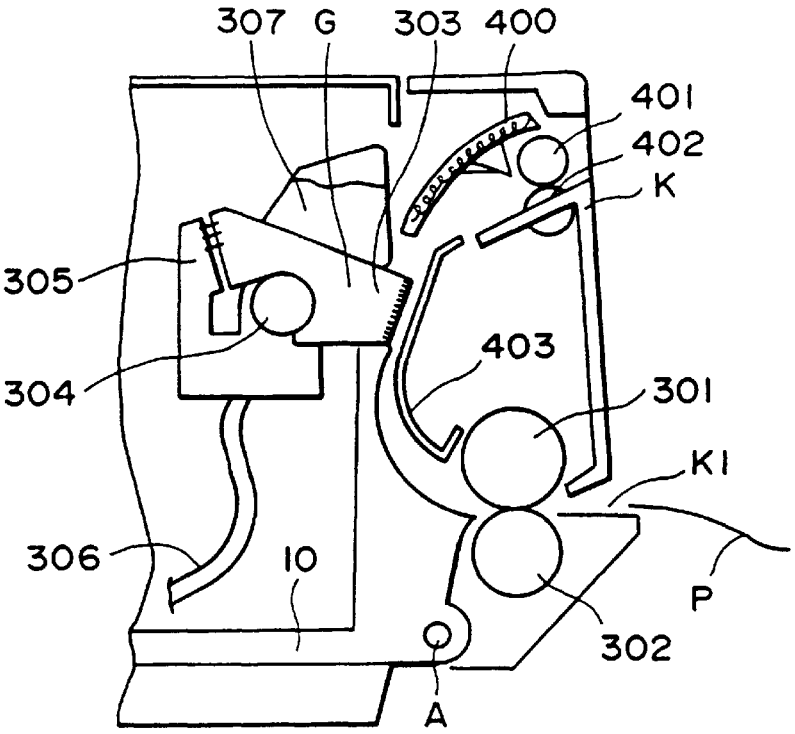
FIGS. 9A and 9B show another embodiment, wherein a sheet conveying portion is illustrated.
Figure 9B:
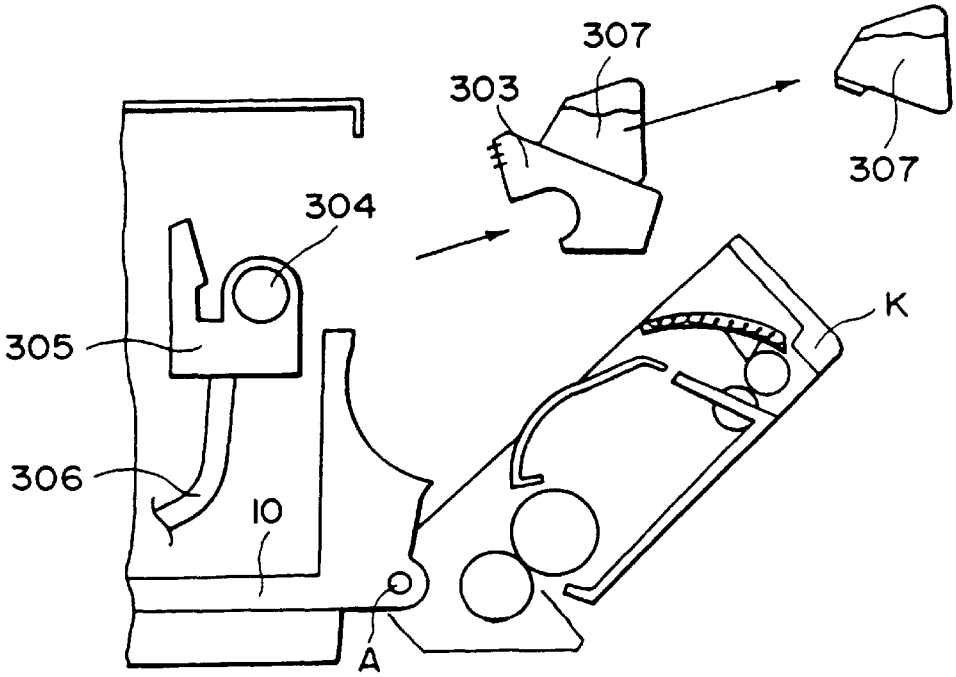

Referring to FIGS. 9A and 9B, another embodiment of the present invention will be described. In the foregoing embodiment, the image forming means includes in combination a laser beam optical system and an electrophotographic process station, but the preset invention is not limited to this, but is applicable to an optical system using LCD (liquid crystal device) and LED (light emitting diode) or an analog optical system as in a copying apparatus using a lens and mirror. FIGS. 9A and 9B are sectional views of a non-impact printer of an ink jet type. A transfer material conveying means supplies a cut sheet P or rolled paper to an image forming station G provided with ink jet nozzles 303 by a couple of conveying rollers 301 and 302 through the paper inlet K1. An image is formed on the sheet P by the ink jet nozzles, and thereafter, the irk is dried by the heating station 400, whereafter it is discharged outside by a couple of discharging rollers 401 and 402. The conveying rollers 301 and 302, a sheet confining member 403 opposed to the nozzles, the heating means as a dryer 400 and the discharging rollers 401 and 402 are constructed as a unit, and the unit is rotatable about a pivot E of the apparatus base 10 as shown in FIG. 9B. By opening the apparatus by rotating the unit about the pivot E, the image forming station G is opened to facilitate jam clearance operation. The ink jet nozzles 303 and an ink tank 307 of the image forming station G are exchangeable as shown in this Figure. In this embodiment, the conveying means, including the conveying roller couple 301 and 302, the discharging roller couple 401 and 402 and the sheet confining member 403, is swingable about the pivot A at a lower position, this is not limiting, and the pivot may be located at an upper position.

The ink jet nozzles 103 303 is arranged in an array, for example, 48–128 nozzles are arranged on a line codirectional with the sheet conveyance, and the array of the nozzle is moved to scan the sheet in the direction perpendicular to the direction of the sheet conveyance (main scan direction), so that the image forming operation is performed by 48–128 nozzles per scan.

The movement of the nozzles in the main scan direction is performed by reciprocating the nozzles 303 on a shaft 304. The movement is provided by an unshown linear motor, a conventional motor, a belt or a wire. On the shaft 304, a head 305 is mounted for supplying electric signals to the ink jet nozzles 303 and for moving the ink jet nozzles 303 in the main scanning direction. The head 305 is electrically connected to a controller in the main assembly by wires 306. The ink jet nozzles 303 are reciprocated in the main scanning direction together with the head 305. The ink jet nozzle assembly is provided on its top with an ink tank 307, which supplies ink to the ink jet nozzles 303. The ink tank 307 itself can be removed from the ink jet nozzles 303.

When the ink is to be supplied, or when the ink tank 307 is exchanged, the cover K are opened, and the ink tank 307 only can be removed for the purpose of exchange, or the ink jet nozzles 303 are taken out together with the ink tank 307, as shown in FIG. 9B, and the ink jet nozzles 303 and/or the ink tank 307 are changed. The opening of the cover K can be utilized to remove a jammed sheet.

Figure 10A:
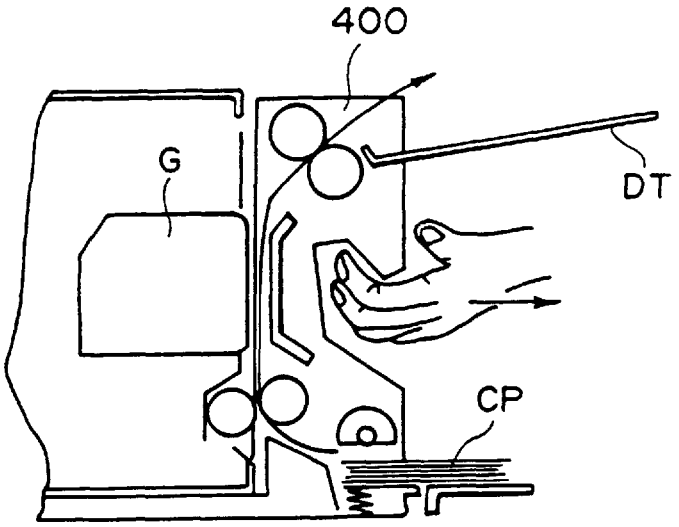
FIGS. 10A and 10B illustrate a further embodiment, wherein the sheet conveying portion is shown.
Figure 10B:
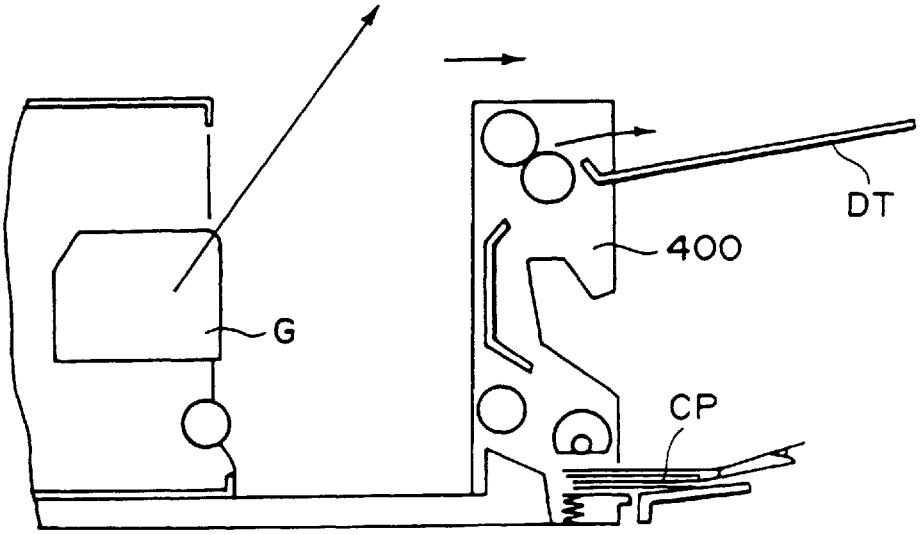

As a further alternative, as shown in FIGS. 10A and 10B, the sheet conveying unit 400 may be slid away from the image forming station G. This is advantageous in that it is not necessary to remove the cut sheets CP and in that it is not necessary to dismount the discharge tray DT.

Figure 11A:
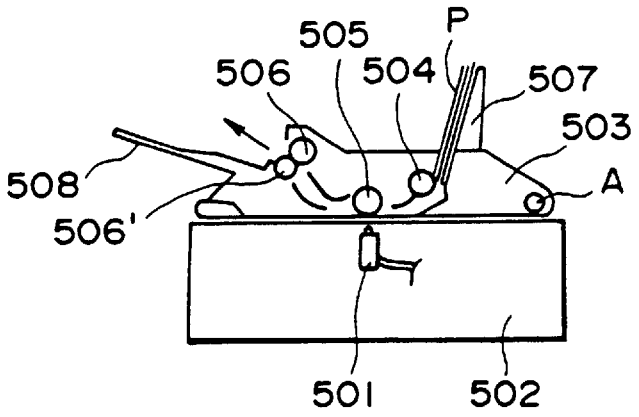
FIGS. 11A and 11B show a yet further embodiment, wherein the sheet conveying portion is shown.
Figure 11B:
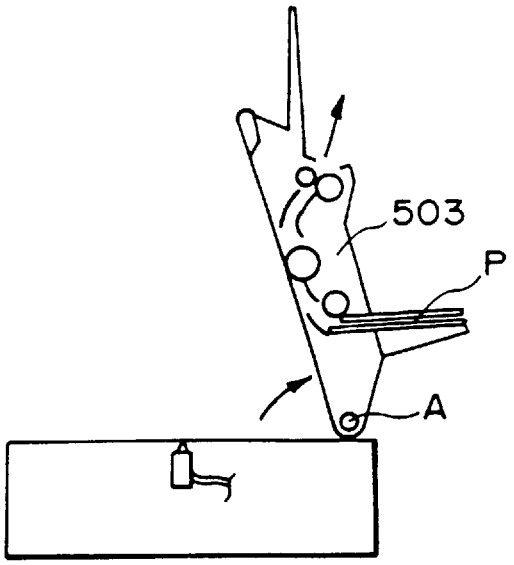

Referring to FIGS. 11A and 11B, a further embodiment of the present invention will be described. In the foregoing embodiments, the sheet conveying means is disposed adjacent a vertical side. In FIG. 11A embodiment, the conveying station is disposed at the top of the apparatus. An image forming means 501 such as an array of ink jet nozzles is disposed in the main assembly 502 of the apparatus, and paper conveying portion 503 for conveying paper P to the image forming means is disposed at the top side so as to be movable toward and away from the image forming means 501, more particularly, in this embodiment, so as to be rotatable about a shaft A. To and from the sheet conveying station 503, the paper is conveyed by a feeding roller 504, a platen roller, and discharging rollers 506 and 506'. The sheet in this embodiment on the feeding tray 507 is introduced into the image forming station and is subjected to an image forming process, and thereafter, the sheet is discharged onto the sheet discharging tray 508.

As shown in FIG. 11B, the sheet conveying station is opened when a jammed sheet is to be removed, when or when maintenance operation such as ink replenishment and ink tank exchange is to be performed.

As described in the foregoing, the position of the sheet conveying mechanism is not limited to the top, the vertical side or bottom of the apparatus, but the spirit of the present invention applies if the sheet feeding mechanism is concentrated to one portion, and it is movable away from the main assembly of the apparatus.

Also, the image forming means movable toward and away from the main assembly may contain only the developing device, only the photosensitive drum or only the cleaning means, or any combination thereof. Also, as will be understood from the foregoing, the type of the image forming means is not limited to the electrophotographic process type.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to a main assembly of an image forming apparatus, the main assembly having a rotatable image transfer roller for transmitting a toner image onto a recording sheet, said process cartridge comprising:

a rotatable photosensitive drum;

process means for forming a toner image on said photosensitive drum, the toner image being transferable onto a recording sheet by said image transfer roller;

a driving force receiving gear, provided at one end of said photosensitive drum, for receiving a driving force from the main assembly to rotate said photosensitive drum; and a driving force outputting gear, provided at the other end of said photosensitive drum, for transmitting the driving force received from said main assembly to rotate said photosensitive drum at said one end, back to the main assembly at the other end of said photosensitive drum to rotate the image transfer roller, wherein the driving force that said driving force receiving gear receives from the main assembly is transmitted from the one end of said photosensitive drum to the other end of said photosensitive drum by said photosensitive drum itself so as to be transmitted to said driving force outputting gear.

2. A process cartridge according to claim 1, further comprising a contact charging roller supplied with a DC bias voltage from the main assembly, for charging the photosensitive drum.

3. A process cartridge according to claim 2, further comprising cleaning means for removing toner remaining on said photosensitive drum.

4. A process cartridge according to claim 2, said process means comprising developing means for supplying toner to said photosensitive drum to develop a latent image formed on said photosensitive drum.

5. A process cartridge according to claim 2, wherein said contact charging roller is further supplied with a AC bias voltages from the main assembly to charge the photosensitive drum.

6. A process cartridge according to either claim 2 or 5 wherein said contact charging roller is a rubber roller.

7. A process cartridge according to claim 6, wherein said rubber roller is semi-electroconductive.

8. A process cartridge according to claim 2, further comprising cleaning means for cleaning residual toner from the photosensitive member at a position upstream of said contact charging roller with respect to a rotational direction of the photosensitive member.

9. A process cartridge according to claim 1, wherein said driving force receiving gear is engageable with a gear in the main assembly.

10. A process cartridge according to claim 1, said process means comprising developing means for supplying toner to said photosensitive drum to form a toner image.

11. A process cartridge according to claim 10, wherein said developing means has a developing sleeve for supplying toner to said photosensitive drum.

12. A process cartridge according to claim 1, further comprising cleaning means for removing residual toner from said photosensitive drum.

13. A process cartridge according to claim 1, wherein an image exposure station for exposing the photosensitive drum to image light through an optical system is disposed between a position where said photosensitive drum is charged and a position where said photosensitive drum is developed.

14. A process cartridge according to any one of claims 1, 2, 5, 9, 10, 11, 12 and 13, wherein said process cartridge is mountable to the main assembly in a direction perpendicular to an axis of said photosensitive drum.

15. A process cartridge according to claim 14, wherein said driving force receiving gear has provided on it at an end opposite from an end having a gear for receiving driving force from the main assembly, an electric contact for establishing an electric connection between said process cartridge and the main assembly when the process cartridge is positioned in place in the main assembly.

16. An image forming apparatus with a main assembly and a process cartridge detachably mountable to the main assembly, for forming an image on a recording sheet, said apparatus comprising:

mounting means for mounting a process cartridge to said image forming apparatus, said process cartridge including:

a rotatable photosensitive drum;

process means for forming a toner image on said photosensitive drum, the toner image being transferable onto the recording sheet by a toner image transfer roller provided in the main assembly, wherein the toner image transfer roller transfers a toner image from said photosensitive drum to the recording sheet;

a driving force receiving gear, provided at one end of said photosensitive drum, for receiving a driving force from the main assembly to rotate said photosensitive drum, and a driving force outputting gear provided at the other end of said photosensitive drum, for transmitting the driving force received from said main assembly to rotate said photosensitive drum at said one end, back to the main assembly at the other end of said photosensitive drum to rotate the toner image transfer roller, wherein the driving force that said driving force receiving gear receives from the main assembly is transmitted from the one end of said photosensitive drum to the other end of said photosensitive drum by said photosensitive drum itself so as to be transmitted to said driving force outputting gear;

image exposure means for exposing said photosensitive drum with image light when said process cartridge is mounted by said mounting means; and feeding means for feeding the recording sheet to said photosensitive drum for transfer of the toner image to the recording sheet.

17. An apparatus according to claim 16, wherein said exposure means comprises a semiconductor laser and a polygonal mirror.

18. An apparatus according to claim 16, wherein said exposure means includes an LED.

19. An apparatus according to claim 16, wherein said toner image transfer roller is effective to position said process cartridge in the main assembly.

20. An apparatus according to claim 16, wherein said image forming apparatus is a copying machine.

21. An apparatus according to claim 16, wherein said image forming apparatus is a printer.

22. An image forming apparatus comprising:

mounting means for mounting a process cartridge, said process cartridge including a rotatable photosensitive drum; process means for forming a toner image on said photosensitive drum; a driving force receiving gear, provided at one end of said photosensitive drum, for receiving a driving force from a main assembly of said process cartridge to rotate said photosensitive drum; a driving force transmitting gear provided at the other end of said photosensitive drum, for transmitting the driving force received from said main assembly to rotate said photosensitive drum at said one end, back to the main assembly at the other end of said photosensitive drum to rotate a transfer roller, wherein the driving force that said driving force receiving gear receives from the main assembly is transmitted from the one end of said photosensitive drum to the other end of said photosensitive drum by said photosensitive drum itself so as to be transmitted to said driving force transmitting gear; and a transfer roller for transferring a toner image formed on said photosensitive drum onto a recording sheet, said transfer roller being driven by said driving force transmitting gear.

23. An apparatus according to claim 22, wherein said process cartridge further includes cleaning means for removing toner remaining on said photosensitive drum.

24. An apparatus according to claim 22, wherein said process means includes developing means for supplying toner to said photosensitive drum to form a toner image on said photosensitive drum.

25. A process cartridge detachably mountable to a main assembly of an image forming apparatus, the main assembly having a rotatable toner image transfer roller for transferring a toner image onto a recording sheet, said process cartridge comprising:

a rotatable photosensitive drum;

a contact charging roller, contacted to said photosensitive drum and rotated by said photosensitive drum, for charging said photosensitive drum;

a developing roller for supplying toner to said photosensitive drum to form a toner image on said photosensitive drum, the toner image transferable onto a recording sheet by said toner image transfer roller;

a cleaning blade for removing toner remaining on said photosensitive drum;

a driving force receiving gear, provided at one end of said photosensitive drum, for receiving a driving force from the main assembly to rotate said photosensitive drum; and a driving force transmitting gear provided at the other end of said photosensitive drum, for transmitting the driving force received from said main assembly to rotate said photosensitive drum at said one end, back to the main assembly at the other end of said photosensitive drum to rotate the toner image transfer roller, wherein the driving force that said driving force receiving gear receives from the main assembly is transmitted from the one end of said photosensitive drum to the other end of said photosensitive drum by said photosensitive drum itself so as to be transmitted to said driving force transmitting gear.

26. A process cartridge according to claim 25, wherein said contact charging roller is supplied with a DC bias voltage from the main assembly and charges the photosensitive drum.

27. A process cartridge according to claim 26, wherein said contact charging roller is further supplied with an AC bias voltage from the main assembly to charge the photosensitive drum.

28. A process cartridge according to any one of claims 24 to 27, wherein said contact charging roller is a rubber roller.

29. A process cartridge according to claim 28, wherein said rubber roller is semi-electroconductive.

30. A process cartridge according to claim 25, wherein said driving force receiving gear is engageable with a gear in the main assembly.

31. A process cartridge according to claim 25, wherein said developing roller includes a developing sleeve for supplying toner to said photosensitive drum.

32. A process cartridge according to claim 25, wherein an image exposure station for exposing the photosensitive drum to image light through an optical system is disposed between a position where said photosensitive drum is charged and a position where said photosensitive drum is developed.

33. A process cartridge according to claim 25, wherein said cleaning blade is located at a position upstream of said contact charging roller with respect to a rotational direction of the photosensitive drum.

34. A process cartridge according to any one of claims 25 to 27 and 30 to 33, wherein said process cartridge is mountable to the main assembly in a direction perpendicular to an axis of said photosensitive drum.

35. A process cartridge according to claim 34, further comprising an electric contact for establishing an electric connection between said process cartridge and the main assembly when the process cartridge is positioned in place in the main assembly.

36. A process cartridge according to claim 28, wherein said process cartridge is mountable to the main assembly in a direction perpendicular to an axis of said photosensitive drum.

37. A process cartridge according to claim 36, further comprising an electric contact for establishing an electric connection between said process cartridge and the main assembly when the process cartridge is positioned in place in the main assembly.

38. A process cartridge according to claim 29, wherein said process cartridge is mountable to the main assembly in a direction perpendicular to an axis of said photosensitive drum.

39. A process cartridge according to claim 38, further comprising an electric contact for establishing an electric connection between said process cartridge and the main assembly when the process cartridge is positioned in place in the main assembly.

40. An image forming apparatus with a main assembly and a process cartridge detachably mountable to the main assembly, for forming an image on a recording sheet, said apparatus comprising:

mounting means for mounting a process cartridge to said image forming apparatus, said process cartridge including a rotatable photosensitive drum; a charging roller, contacted to said photosensitive drum and rotated by said photosensitive drum, for charging said photosensitive drum; a developing roller for supplying toner to said photosensitive drum to form a toner image on said photosensitive drum, the toner image being transferable onto a recording sheet by a toner image transfer roller provided in the main assembly; a cleaning blade for removing toner remaining on said photosensitive drum; a driving force receiving gear, provided at one end of said photosensitive drum, for receiving a driving force from the main assembly to rotate said photosensitive drum; and a driving force transmitting gear provided at the other end of said photosensitive drum, for transmitting the driving force received from said main assembly to rotate said photosensitive drum at said one end, back to the main assembly at the other end of said photosensitive drum to rotate the toner image transfer rollers wherein the toner image transfer roller transfers the toner image from said photosensitive drum of said process cartridge to the recording sheet, and wherein the driving force that said driving force receiving gear receives from the main assembly is transmitted from the one end of said photosensitive drum to the other end of said photosensitive drum by said photosensitive drum itself so as to be transmitted to said driving force transmitting gear.

41. An apparatus according to claim 40, further comprising image exposure means, including a semiconductor laser and a polygonal mirror, for exposing said photosensitive drum with image light when said process cartridge is mounted by said mounting means.

42. An apparatus according to claim 41, wherein said exposure means includes an LED.

43. An apparatus according to claim 41, wherein said toner image is effective to position said process cartridge in the main assembly.

44. An apparatus according to claim 40, wherein said image forming apparatus is a copying machine.

45. An apparatus according to claim 40, wherein said image forming apparatus is a printer.

46. A process cartridge detachably mountable to a main assembly of an image forming apparatus, the main assembly having a rotatable toner image transfer roller for transferring a toner image onto a recording sheet, said process cartridge comprising:

a cartridge frame;

a rotatable photosensitive drum;

a rubber contact charging roller, contacted to said photosensitive drum and rotated by frictional contact with said photosensitive drum, for charging said photosensitive drum;

a developing sleeve for supplying toner to said photosensitive drum to form a toner image on said photosensitive drum, wherein the toner image is transferred to the recording sheet from said photosensitive drum;

a rubber blade contacted to a surface of said developing sleeve to form a layer of toner on said developing sleeve;

a cleaning blade for removing toner remaining on said photosensitive drum after the toner image is transferred to the recording sheet;

a residual toner container for containing toner removed by said cleaning blade:

a driving force receiving gear provided at a first longitudinal end of said photosensitive drum, for receiving a driving force from the main assembly to rotate said photosensitive drum;

a driving force transmitting gear provided at a second longitudinal end of said photosensitive drum, for transmitting the driving force received from said main assembly to rotate said photosensitive drum at said first longitudinal end of said photosensitive drum, back to the main assembly at the second longitudinal end of said photosensitive drum to rotate the toner image transfer roller; and a plurality of electric contacts provided at a portion of said cartridge frame at said second longitudinal end of said photosensitive drum for electrical connection to the main assembly, wherein the driving force that said driving force receiving gear receives from the main assembly is transmitted from said first longitudinal end of said photosensitive drum to said second longitudinal end of said photosensitive drum by said photosensitive drum itself so as to be transmitted to said driving force transmitting gear.

47. A process cartridge according to claim 46, wherein said contact charging roller is supplied with a DC bias voltage from the main assembly and charges the photosensitive drum.

48. A process cartridge according to claim 47, wherein said contact charging roller is further supplied with an AC bias voltage from the main assembly to charge the photosensitive drum.

49. A process cartridge according to claim 46, wherein said rubber roller is semi-electroconductive.

50. A process cartridge according to claim 49, further comprising an electric contact for establishing an electric connection between said process cartridge and the main assembly when the process cartridge is positioned in place in the main assembly.

51. A process cartridge according to claim 46, wherein said driving force receiving gear is engageable with a gear in the main assembly.

52. A process cartridge according to claim 46, wherein an image exposure station for exposing the photosensitive drum to image light through an optical system is disposed between a position where said photosensitive drum is charged and a position where said photosensitive drum is developed.

53. A process cartridge according to claim 46, wherein said cleaning blade is located at a position upstream of said contact charging roller with respect to a rotational direction of the photosensitive drum.

54. A process cartridge according to claim 46, further comprising an electric contact for establishing an electric connection between said process cartridge and the main assembly when the process cartridge is positioned in place in the main assembly.

55. A process cartridge according to claim 46, further comprising an electric contact for establishing an electric connection between said process cartridge and the main assembly when the process cartridge is positioned in place in the main assembly.

56. A process cartridge according to any one of claims 46, 47 and 48, wherein said process cartridge is mountable to the main assembly in a direction perpendicular to an axis of said photosensitive drum.

* * * * *

UNITED STATES PATENT AND TRADEMARK OFFICE

CERTIFICATE OF CORRECTION

PATENT NO. : 5,875,374

DATED : February 23, 1999

INVENTOR(S) : YUTAKA KIKUCHI, ET AL.

It is certified that error appears in the above-identified patent and that said Letters Patent is hereby corrected as shown below:

COLUMN 1,
Line 51, "changer," should read --charger,--, and
"changer" should read "charger--; and
Line 52, "form" should read --from--.

COLUMN 2,
Line 11, "image." should read --images.--;
Line 28, "entirely" should read --entirety--; and
Line 67, "upon" should read --upon jam--.

COLUMN 5,
Line 33, "when" should read --When--; and
Line 46, "pad" should read --pad 12--.

COLUMN 6,
Line 36, "correspond" should read --corresponds--.

COLUMN 7,
Line 7, "thermo switch" should read --thermo-switch--.

COLUMN 8,
Line 23, "is" should read --are--;
Line 27, "the the" should read --the--;

UNITED STATES PATENT AND TRADEMARK OFFICE

CERTIFICATE OF CORRECTION

PATENT NO. : 5,875,374

DATED : February 23, 1999

INVENTOR(S) : YUTAKA KIKUCHI, ET AL.

It is certified that error appears in the above-identified patent and that said Letters Patent is hereby corrected as shown below:

COLUMN 8 (Cont.),
Line 56, "-50--150V." should read -- -50 - -150V.--; and
Line 64, "is" should read --are--, and "vias" should read --bias--.

COLUMN 9,
Line 55, "to" should read --at--; and
Line 56, "am" should read --jam.

COLUMN 10,
Line 6, "irk" should read --ink--;
Line 21, "position," should read --position, but--;
Line 23, "103 303 is" should read --303 are--; and
Line 44, "are" should read --is--.

COLUMN 11,
Line 65, "a" should read --an--; and
Line 66, "voltages" should read --voltage--.

COLUMN 12,
Line 6, "member" should read --drum--; and
Line 8, "member." should read --drum.--.

UNITED STATES PATENT AND TRADEMARK OFFICE

CERTIFICATE OF CORRECTION

PATENT NO. : 5,875,374

DATED : February 23, 1999

INVENTOR(S) : YUTAKA KIKUCHI, ET AL.

It is certified that error appears in the above-identified patent and that said Letters Patent is hereby corrected as shown below:

COLUMN 14,
Line 18, "claims 24" should read --claims 25--.

COLUMN 15,
Line 21, "rollers" should read --roller,--;
Line 38, "image" should read --image transfer roller--;
and
Line 67, "blade:" should read --blade;--.

Signed and Sealed this

Fourteenth Day of September, 1999

*Attest:*

Q. TODD DICKINSON

*Attesting Officer*

*Acting Commissioner of Patents and Trademarks*